US010364067B2

(12) United States Patent
Mayer et al.

(10) Patent No.: US 10,364,067 B2
(45) Date of Patent: Jul. 30, 2019

(54) INTERCONNECTABLE INDIVIDUAL PACKAGE

(71) Applicants: Markus Mayer, Lindau (DE); Wolfgang Sohler, Wangen (DE); Klaus Giegerich, Hergensweiler (DE); Thiemo Roesler, Wangen (DE)

(72) Inventors: Markus Mayer, Lindau (DE); Wolfgang Sohler, Wangen (DE); Klaus Giegerich, Hergensweiler (DE); Thiemo Roesler, Wangen (DE)

( * ) Notice: Subject to any disclaimer, the term of this patent is extended or adjusted under 35 U.S.C. 154(b) by 0 days.

(21) Appl. No.: 15/222,309

(22) Filed: Jul. 28, 2016

(65) Prior Publication Data

US 2017/0029167 A1 Feb. 2, 2017

(30) Foreign Application Priority Data

Jul. 31, 2015 (DE) ..... 10 2015 009 734

(51) Int. Cl.

| | |
|---|---|
| ***B65D 21/028*** | (2006.01) |
| ***B65D 21/02*** | (2006.01) |
| ***B65D 43/16*** | (2006.01) |
| ***B65D 43/22*** | (2006.01) |
| *B65D 6/00* | (2006.01) |

(52) U.S. Cl.

CPC ..... *B65D 21/0204* (2013.01); *B65D 43/16* (2013.01); *B65D 43/164* (2013.01); *B65D 43/22* (2013.01)

(58) Field of Classification Search

CPC .... B65D 21/02; B65D 21/0204; B65D 43/16; B65D 43/164; B65D 43/22

USPC ..... 220/23.4, 23.6, 4.24, 4.22; 206/504

See application file for complete search history.

(56) References Cited

U.S. PATENT DOCUMENTS

| | | | | | |
|---|---|---|---|---|---|
| 3,317,081 | A * | 5/1967 | Cornelius | B65D 21/0204 | 206/144 |
| 3,999,818 | A * | 12/1976 | Schankler | A47B 87/02 | 312/107 |
| 4,889,254 | A * | 12/1989 | Vola | A45C 7/0045 | 132/294 |
| 5,310,071 | A * | 5/1994 | Rivlin | B65D 81/361 | 206/509 |
| 5,310,076 | A * | 5/1994 | Burton | H05K 7/023 | 206/719 |
| 5,547,082 | A * | 8/1996 | Royer | H05K 13/0084 | 206/564 |

(Continued)

FOREIGN PATENT DOCUMENTS

CN 201056322 5/2008

*Primary Examiner* — J. Gregory Pickett
*Assistant Examiner* — Niki M Eloshway
(74) *Attorney, Agent, or Firm* — Cohen & Grigsby PC

(57) ABSTRACT

Package (1, 1*a*, 1*b*), consisting of a base (3) and a cover (2), wherein the package (1*a*) has connecting means (5, 6, 9) for a detachable plug connection with another package (1*b*), wherein at least one lower profile rib (5, 5*a*, 5*b*) is arranged on at least one lateral surface of the package (1, 1*a*, 1*b*) and at least one upper profile rib (6, 6*a*, 6*b*) is arranged at a vertical distance, which profile ribs form a form-fitting guide for at least one connector (9, 9*a*, 9*b*), which is arranged on at least one other lateral surface of the package (1, 1*a*, 1*b*), wherein the lower profile rib (5, 5*a*, 5*b*) has an offset (15) with respect to the upper profile rib (6, 6*a*, 6*b*) in the slide direction.

18 Claims, 6 Drawing Sheets

(56) References Cited

U.S. PATENT DOCUMENTS

| | | | | |
|---|---|---|---|---|
| 5,772,038 | A * | 6/1998 | Murata | H01L 21/67333 206/564 |
| 6,185,827 | B1 | 2/2001 | Polites | |
| 2002/0079313 | A1* | 6/2002 | Grayson | A01K 97/06 220/23.4 |
| 2008/0217340 | A1* | 9/2008 | Jager | B65D 21/0204 220/524 |
| 2013/0056462 | A1* | 3/2013 | Furuta | B62B 3/006 220/23.4 |
| 2015/0321791 | A1* | 11/2015 | Stanek | B65D 1/34 29/428 |

* cited by examiner

INTERCONNECTABLE INDIVIDUAL PACKAGE

FIELD OF THE INVENTION

The invention relates to an interconnectable individual package comprising at least two lower profile ribs that are arranged on a first lateral surface of the package; at least two upper profile ribs arranged on the first lateral surface of the package, each of the upper profile ribs being vertically spaced apart from a respective one of the lower profile ribs, each of the upper profile ribs also being offset in a longitudinal direction from the respective one of the lower profile ribs, each of the upper profile ribs cooperating with the respective one of the lower profile ribs to define a guide groove; and at least two connectors that are arranged on a second lateral surface of the package, each of the connectors cooperating with a respective guide groove on the adjacent package to form a detachable plug connection, wherein each of the connectors define a connector profile configured to engage the guide groove in a form-fitting manner.

DISCUSSION OF THE PRIOR ART

An interconnectable individual package is disclosed for example in US 2002/0079 313 A1. The document describes a modular storage system, wherein individual packages have profiled plug connectors on the side walls thereof. The plug connectors are designed for one as tongues (prongs) and also as grooves. Together they form a dovetail connection.

These types of dovetail connections are already known from the prior art as a detachable plug connection. A first disadvantage of this type of connection is that they must be inserted very precisely because of the high level of form-fit over the entire longitudinal extension. Therefore, the user must always arrange the two connecting parts at the same height in order to execute the insertion process in a clean manner.

Furthermore, if there is any soiling, the insertion process can only be carried out with difficulty or not at all.

A further disadvantage of the arrangement of dovetail connections is that they cant easily. Thus, two canted packages can be detached from each other only with difficulty.

A lateral insertion guide for individual packages is also shown in Document GB 2 169 264 A. According to FIG. 8 and FIG. 9, L-shaped longitudinal and vertical guides are disclosed, which engage in each other in a form-fitting manner during an insertion process. A disadvantage of this embodiment is that relatively long guide paths are required to obtain a stable snap-fit. The insertion process of the two packages is therefore very complicated. Furthermore, due to the high level of form-fit, the two guides must be brought together in a clean manner.

Document U.S. Pat. No. 4,428,479 also shows the connection possibility for individual packages. FIG. 11 shows individual guide elements, which are configured to be relatively short and are arranged at a far distance from each other. However, the disadvantage of this is that a slight canting occurs and it is also relatively difficult to hit both guide noses (upper, lower) at the same time. Thus, the same relative angle as well as the same direction must be found every time during the insertion process of the cassette packages. As a result, the connecting process of the packages is relatively complicated and cumbersome.

Therefore, the object of the present invention is to provide an individual package with connecting elements which make a simple and quick connection between the individual packages possible.

SUMMARY OF THE INVENTION

The essential feature of the invention is that at least two profiled upper profile ribs and at least two profiled lower profile ribs, which have an offset in the slide direction, are arranged on the package on at least one lateral surface. The two profile ribs are preferably arranged in pairs and extend only partially along the longitudinal axis of the individual package.

The upper and the lower profile ribs are configured as profiled projections and together form a longitudinal guide for at least one connector. In doing so, the connector is preferably located on another lateral surface of the package. In a connection process of two separate packages, the connector of the first package is inserted between the upper and lower profile ribs of the second package. A form-fitting and detachable connection forms between the two packages because of the profile shape of the connector and the profiled shape of the profile ribs.

The upper and lower profile ribs and the connector together form a type of tongue-and-groove connection. With a first preferred embodiment, at least one upper profile rib and at least one lower profile rib are located on a lateral surface of the package, which are arranged in an opposing manner and at a vertical distance. The two profile ribs together respectively form a longitudinal guide between themselves. The profile ribs extend at least partially over the entire longitudinal axis of the package and have an offset in the slide direction. At least one profiled connector that is configured in an elongated manner is located on the opposite lateral surface of the package.

In a second preferred embodiment, the upper profile ribs and the lower profile ribs are at a vertical distance and are arranged offset in the slide direction. The upper and lower profile ribs extend in this case do not extend over the entire lateral surface of the package, but are present only as individual sections, wherein there is a free space between the two profile ribs.

The profile ribs are preferably located in the slide direction in the front and rear part of the package. The offset of the upper profile rib with respect to the lower profile rib in the longitudinal direction is large enough in this case that the two ribs do not overlap.

Due to the offset arrangement of the upper and lower profile ribs in pairs and the offset arrangement of the connectors in pairs, it is possible for the first time that, as a part of the insertion process, the two connectors are inserted into the interspace of the two upper and lower profile ribs and then engage in a form-fitting manner in the longitudinal guide formed in the process. This makes it possible to bring two packages together also at an angle for the first time.

In a preferred embodiment, the profiled connector has a T-shaped profile, which can be inserted into the profiled L-shaped guides (guide groove) of the upper and lower profile ribs. The advantage of the arrangement in sections and the offset of the upper profile rib with respect to the lower profile rib in the slide direction is that the L-shaped guides are upwardly or downwardly open and that it is not possible for dirt to accumulate in this region.

This is not known from the prior art, because in this case the guide ribs are always spaced apart vertically, but arranged overlapping, one above the other, and were thereby very susceptible to the accumulation of dirt.

A further advantage of the offset, arrangement of the upper and lower profile ribs in sections is that this arrangement is simpler to produce, because it is possible to dispense with a complicated tool device.

In another preferred embodiment, the upper profile rib has a snap-on connection so that a detachable detent mechanism is achieved between the two packages when the connector of another package is inserted.

However, the embodiment according to the invention is not limited to a plug connection between two packages. On the contrary, a form-fitting plug connection between a package and a holding plate is also possible. Such a holding plate can be arranged for example on a production machine. Due to the simple insertion process, the user can easily and securely arrange the individual packages on the holding plate. This is of particular interest if there are strong vibrations in the area near production and the individual packages must be kept secure from possible slipping.

In another preferred embodiment, the upper and the lower profile ribs each have an insertion chamfer at the beginning of their guide grooves. The corresponding connector also has an insertion chamfer so that the two packages can be easily connected to each other.

The package according to the invention can be configured to be both open as well as closeable with a cover. In this case, a hinge is put on the cover on one side.

In another preferred embodiment, the individual package according to the invention has a hinge, which connects the base region of the package to the cover. The hinge is configured such that it grips around the pin of the cover by almost 180 degrees in the upper region, thereby achieving a special guidance system. Thus, an easy assembly of the cover with the base region is possible in an open state. If the package is now closed, a rib in the cover region acts on the hinge and therefore prevents a subsequent displacement of the cover with respect to the base region.

In another preferred embodiment, the individual package is sealed with a label in the closed state in the front region near the grip so that a manipulation or a removal of the object stored therein is no longer possible.

It is possible for the first time with the package that is essential to the invention to connect individual packages to each other during the manufacturing process, wherein the covers can be successively closed during the packing process and it is not mandatory to close them at the same time.

Particularly because of the special formation of the hinge and the special latching function in the grip region it is now possible to close individual packages, while other adjacent packages continue to be open in order to deposit goods there.

In addition, an automatic closing is possible during the production process with the package that is essential to the invention. This is achieved in particular in that there is a detent mechanism in the region close to the grip and that additional closing with a further actuation means is not required.

The subject matter of the present invention is yielded not only from the subject matter of the individual patent claims, but also from the combination of the individual patent claims with one another.

All information and features disclosed in the documents, including the abstract, and in particular the three-dimensional embodiment depicted in the drawings, are hereby claimed as essential to the invention inasmuch as they are novel individually or in combination over the prior art.

The invention is explained in greater detail in the following on the basis of several drawings which illustrate several means of embodiment. Additional features that are essential to the invention and advantages of the invention can be derived from these drawings and the description thereof.

DESCRIPTION OF A PRESENTLY PREFERRED EMBODIMENT

Figure 1:
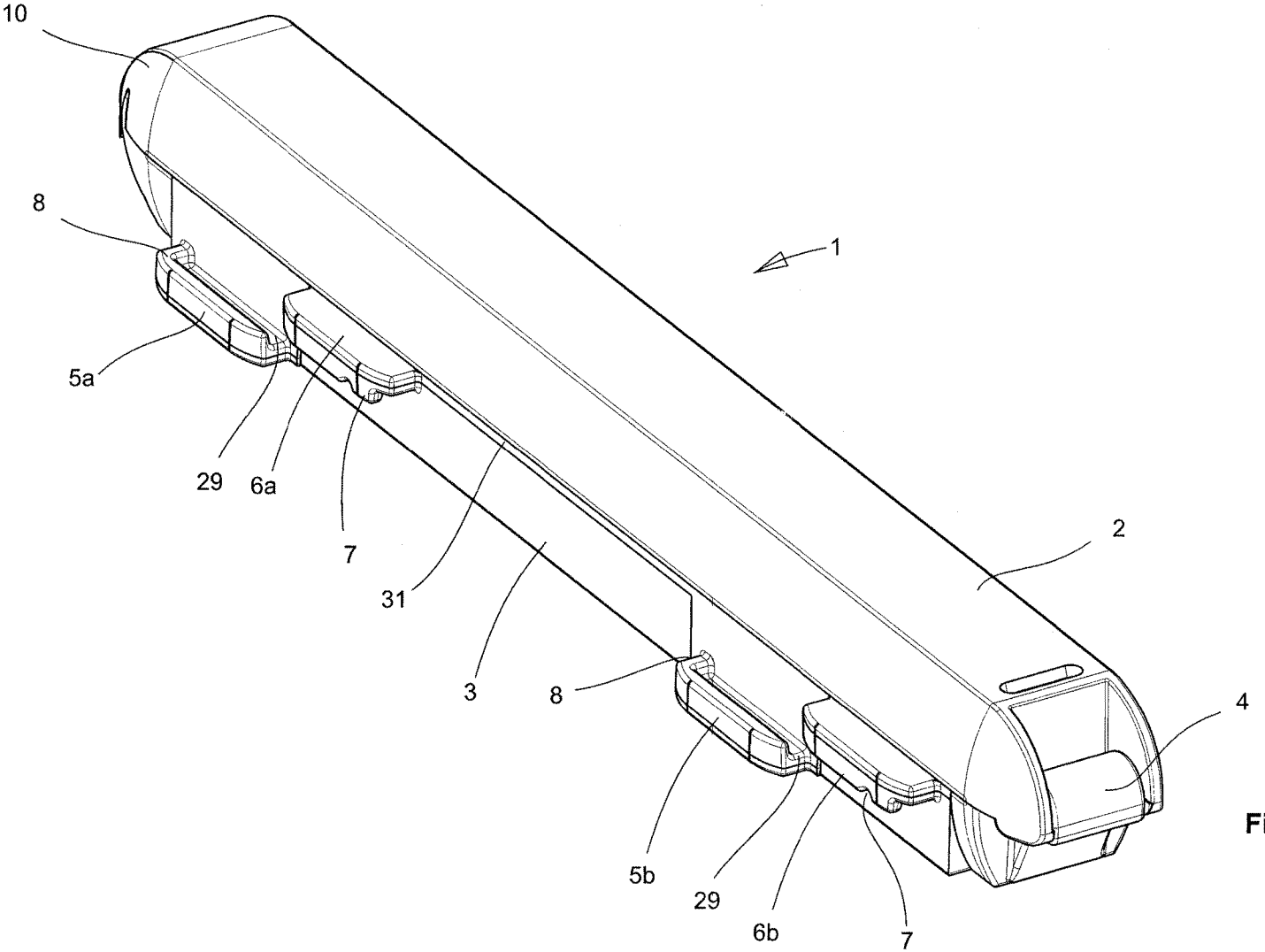
FIG. 1: Perspective representation of the package that is essential to the invention

FIG. 1 shows the package 1 that is essential to the invention. The package 1 consists essentially of a cover 2 and base 3 arranged underneath. The cover 2 is connected to the base 3 in a slewable manner by a hinge 4.

According to FIG. 1, two projections protruding from the lateral surface, which are configured as lower profile ribs 5*a*, 5*b* for mutual connection to another package 1, are located at a lateral surface of the base 3. The lower profile ribs 5*a* and 5*b* do not extend over the entire lateral surface of the package 1, but are arranged only in sections and form a free space 31 between the sections. Of course, the present invention is not limited to the arrangement of two lower profile ribs, rather claims protection for any number of profile ribs.

Two upper profile ribs 6*a* and 6*b* are arranged at a vertical distance from the lower profile ribs 5*a* and 5*b*. A profiled guide groove 29 for a connector 9 with a profile 30 is formed due to the vertical distance and because of the profiled shape of the profile ribs 5, 6.

The present invention considers profile ribs 5, 6 to be projections which protrude over the lateral surface of the base 3. In this case, the upper and lower profile ribs 5, 6 can assume a guide function for the corresponding connector in the longitudinal direction, as well as in the vertical direction.

In addition, the two profile ribs 5, 6 can have any arbitrary shape, wherein the shape of the profile ribs 5, 6 always makes a form-fit and a detachable plug connection with another component (e.g., a connector 9) possible.

In addition, the profile ribs 5, 6, as well as the corresponding connectors 9 can be arranged on all surfaces of the package 1. Thus, for example an arrangement of the profile ribs 5, 6 and the connector 9 on a lateral surface of the cover 2 of the package 1 is likewise possible.

According to FIG. 1, a lower profile rib 5*a* and an upper profile rib 6*a* are each located on the front part of the package 1 and a lower profile rib 5*b* and an upper profile rib 6*b* are each located on the rear part of the package 1.

The lower profile ribs 5*a*, 5*b* and the upper profile ribs 6*a*, 6*b* are arranged along to the longitudinal axis of the package 1 in pairs or in groups so that the lower profile rib 5*a* and the upper profile rib 6*a* form a guide pair in the front part of the base 3 of the package 1, while the lower profile rib 5*b* and the upper profile rib 6*b* form another guide pair in the rear part of the package 1.

It is decisive that the two profile rib pairs 5*a*, 6*a* and 5*b*, 6*b* are present along the longitudinal axis of the package 1 only in sections and form a free space 31 between them. Therefore, there is no guide from a profile rib in the region of the free space 31. The free space 31 makes it possible in particular to easily bring the connectors 9 together in the profile ribs 5, 6.

FIG. 1 furthermore shows that the upper profile ribs 6*a*, 6*b* have an offset 15 in the longitudinal direction (slide direction) of the package 1 with respect to the lower profile ribs 5*a*, 5*b*. The offset 15 in this case is large enough that the respective lower profile ribs 5 and upper profile ribs 6 are not arranged one above the other (overlapping).

Both the lower profile ribs 5*a*, 5*b*, as well as the upper profile ribs 6*a*, 6*b* have a L-shaped profile, wherein a guide for the connector 9 is formed between the L-leg and the lateral surface of the package 1.

While the formed guide groove 29 of the lower profile ribs 5*a*, 5*b* are upwardly open (on the cover side), the guide grooves 29 of the upper profile ribs 6*a*, 6*b* are upwardly closed (on the cover side) or downwardly open.

Even though upper and lower profile ribs 5, 6 were already known from the prior art, they were always arranged vertically overlapping, one above the other, so that it was very easy for dirt to accumulate between the guide grooves.

The essential advantage of the arrangement of the upper and lower profile ribs 5, 6 with an offset 15 in the longitudinal direction of the package 1 is that the accumulation of dirt between the upper and lower profile ribs 5, 6 is reduced considerably, because the respective guide groove 29 is open towards at least one side (upper/lower).

FIG. 1 furthermore shows that the upper profile rib 6 has a detent mechanism 7, which secures the connector 9 in the longitudinal direction in a notched state.

The lower profile rib 5 furthermore has a longitudinal stop 8 for the connector 9. Because of the longitudinal stop 8 of the package 1*a*, the connector 9 of the other package 1*b* can only be inserted in a limited way in the longitudinal direction of the package 1*a* so that there is an alignment of the two connectable packages 1*a*, 1*b* that can be connected to each other.

The longitudinal stop 8 is supported by the detent mechanism 7, wherein a locking nose engages in a recess of the connector 9. The connector 9 is the counterpart to the lower profile ribs 5*a*, 5*b* and the upper profile ribs 6*a*, 6*b* that are essential to the invention. Because of the connector 9, which is preferably arranged on the opposite lateral surface of the package 1, it is possible to connect individual packages 1*a*, 1*b* with each other.

It is decisive that the connector 9 has a shape with which a form-fitting plug connection is achieved with the upper and lower profile ribs 5, 6.

The lower profile ribs 5 and the upper profile ribs 6, which are preferably arranged in pairs and with an offset 15, form the female connecting part, while the connector 9 on the opposite side of the package 1 forms the male connecting part.

In addition, the longitudinal stop 8 of the lower profile rib 5 prevents the package 1*a*, 1*b* from being connected incorrectly.

Figure 2:
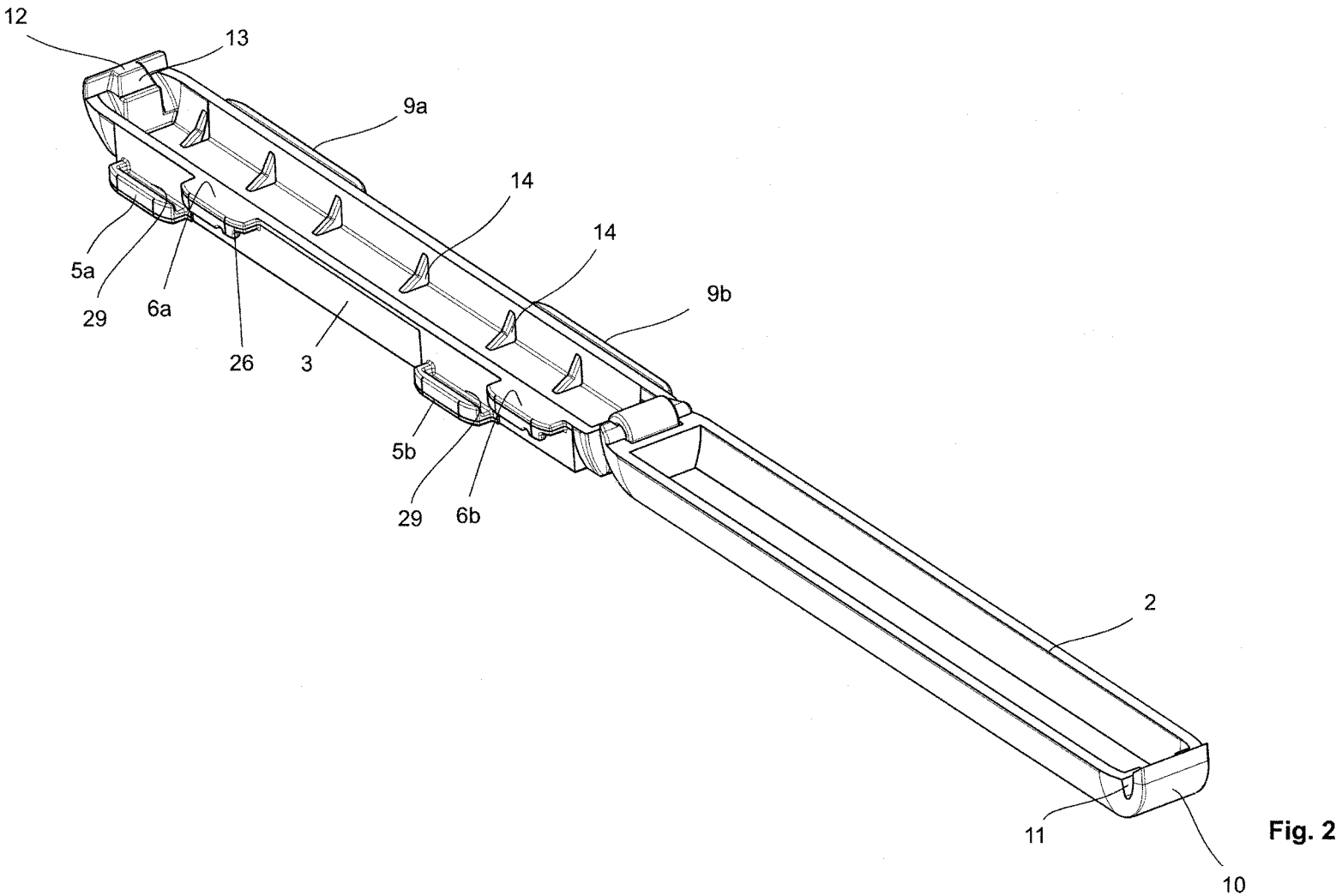
FIG. 2: Depiction of the package in an opened state

FIG. 2 shows a perspective of an opened package 1, wherein individual receptacles 14 are depicted in the base region 3. The receptacles are supposed to hold the packaged product securely in the package 1.

The connector 9*a*, 9*b* is arranged in duplicate on the lateral surface of the base region 3. For a secure (plug) connection, two pairs of the lower profile ribs 5*a*, 5*b* and upper profile ribs 6*a*, 6*b* are always required and the respectively matching connectors 9*a* and 9*b*.

FIG. 2 moreover shows that there is a free space 31 between the spaced-apart lower profile ribs 5*a*, 5*b* or the upper profile ribs 6*a*, 6*b* so that the guide does not extend over the entire longitudinal extension of the package 1. The essential advantage of this is that not just material is saved when manufacturing the package 1, but the package 1 is also lighter and easier to manufacture.

The lower profile ribs 5*a*, 5*b* and the upper profile ribs 6*a*, 6*b* are not limited hereby to the number two, rather a plurality of such profile rib pairs can also be arranged over the longitudinal extension. The same applies to the connector 9*a*, 9*b*, because it can also be arranged multiple times over the longitudinal extension of the package 1.

Another advantage of the interruption of the profile rib pairs 5*a*, 5*b* and 6*a*, 6*b* is that it makes it easier to join the connectors 9*a*, 9*b* together with the matching lower profile rib pairs 5*a*, 5*b* and upper profile rib pairs 6*a*, 6*b*. This was not known from the prior art, because in this case long profile ribs and therefore also long guide paths were provided, which have a relatively small insertion area. As a result, it was very complicated to insert the connector 9 into the insertion area of the profile rib pairs 5, 6. The plug connection 5, 6, 9 according to the invention makes a slightly oblique joining together of the packages 1*a*, 1*b* possible instead.

According to FIG. 2, a grip 10 is also arranged in the front region of the cover 2, which is easy for the user of the package 1 to open.

Furthermore, the grip 10 has a recess 11, which interacts with a centering device 13 and a tongue 12 in the base region. Thus, a secure closing of the package 1 between the cover 2 and the base 3 is achieved with the recess 11 of the grip 10 and the tongue 12 together with the centering device.

The present embodiment makes do without an additional actuation means or closure means. However, the invention is not limited to this, because a subsequent affixing for example of an adhesive or a label or an additional clasp is possible at all times.

Figure 3:
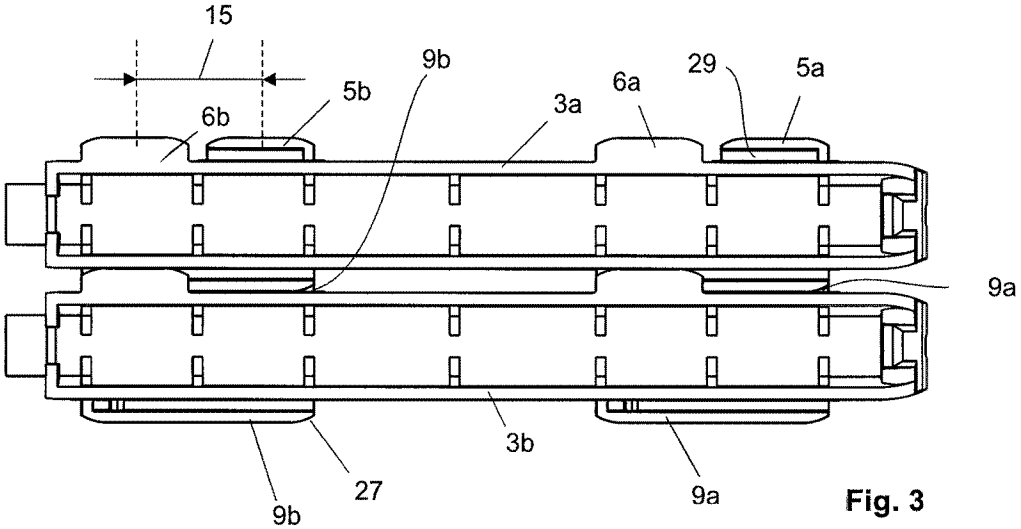
FIG. 3: Top view of the base of the package

FIG. 3 shows a top view of two base regions 3 of two packages 1*a*, 1*b*.

The base region 3 has two guide pairs of the lower profile ribs 5*a*, 5*b* and of the upper profile ribs 6*a*, 6*b* in each case. The two guide pairs each have an offset 15 in longitudinal direction of the packages 1*a*, 1*b*. Thus, the upper profile rib 6*a* is arranged with an offset 15 with respect to the lower profile rib 5*a*. The upper profile rib 6*b* is likewise arranged with an offset 15 with respect to the lower profile rib 5*b*. The offset 15 is large enough in this case that the upper profile ribs 6*a*, 6*b* do not cover the lower profile ribs 5*a*, 5*b* in the vertical direction.

However, the invention is not limited to the offset 15, on the contrary, in another embodiment the profile rib pairs 5, 6 can also be arranged one above the other, i.e., vertically overlapping.

The package 1 can be manufactured of plastic for example. However, protection is claimed for all materials so that the package 1 can also be made of metal, a light metal or the like.

According to FIG. 3, the base 3 of each of the packages 1*a*, 1*b* has two connectors 9*a*, 9*b* spaced apart in the longitudinal direction.

Figure 4:
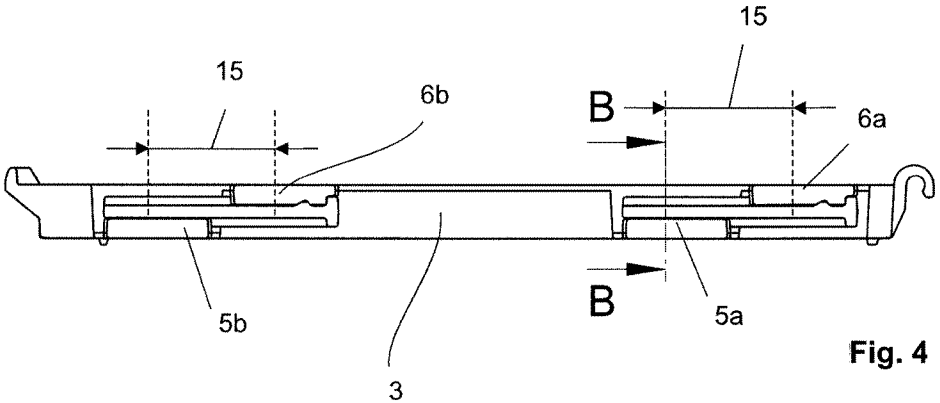
FIG. 4: Lateral view of the base

FIG. 4 again shows the offset 15 of the lower profile rib 5*a* with respect to the upper profile rib 6*a* and the lower profile rib 5*b* with respect to the upper profile rib 6*b*.

Moreover, it shows that the lower profile rib 5 and the upper profile ribs 6 are spaced apart vertically so that the connector 9 can be slid through between the two profile rib guides. The connector 9 can have a T-profile-like embodiment, which engages in the recesses of the lower profile ribs 5*a*, 5*b* and the upper profile ribs 6*a*, 6*b*. This constitutes an essential difference with respect to the dovetail connection, because such a connection has an undercut, which is extremely susceptible to soiling, and furthermore makes the precise insertion of the connector necessary.

In a preferred embodiment, the formed guide grooves 29 of the profile ribs 5, 6 are slightly larger than the cross-sections of the T-shaped connector 9 so that a smooth plug connection is achieved.

Figure 5:
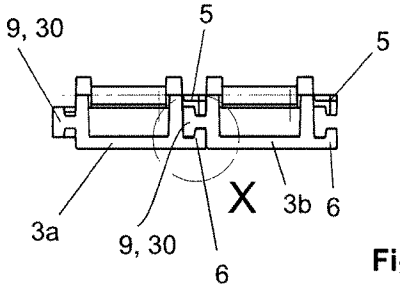
FIG. 5: Depiction of the inserted connection of two base regions

According to FIG. 5, the plug connection of two base regions 3*a*, 3*b* of two packages 1*a*, 1*b* is shown again. Reference sign 9 indicates the T-shaped connector, which is arranged in a form-fitting manner between the upper profile rib 6 and the lower profile rib 5.

It is decisive that the lower profile rib 5 and the upper profile rib 6 are arranged on a base region 3*a* of a first package 1*a*, while the connector 9 belongs to another base region 3*b* of another package 1*b*.

Figure 6:
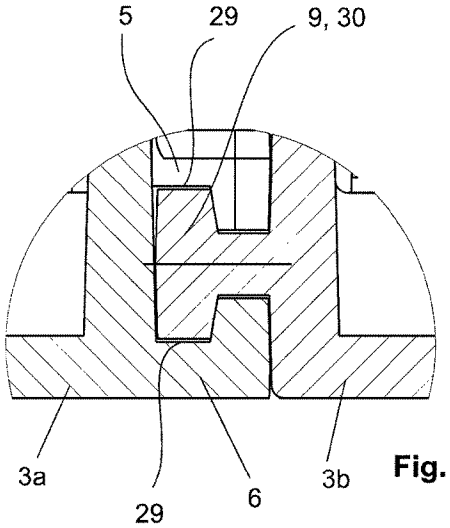
FIG. 6: Detailed section of FIG. 5, in particular of the plug connection

FIG. 6 shows the form-fitting plug connection between the profile ribs 5, 6 and the connector 9 in detail. The T-shaped connector 9 engages in the groove-like recess of the profile ribs 5, 6, which are arranged at a vertical distance from one another.

Figure 7:
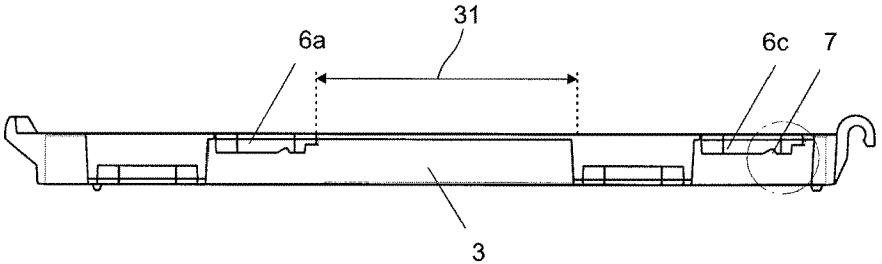
FIG. 7: Depiction of the base of the package shown as a lateral view

FIG. 7 depicts the base 3 of the package 1. Moreover, a notch 7, which is configured as a profiled recess, is arranged in the region of the upper profile rib 6*a*, 6*b*. A projection 16 of the connector 9 engages in the notch 7. This produces an additional securing of the connector 9 that is inserted into the guides 5, 6 in the longitudinal direction.

Figure 8:
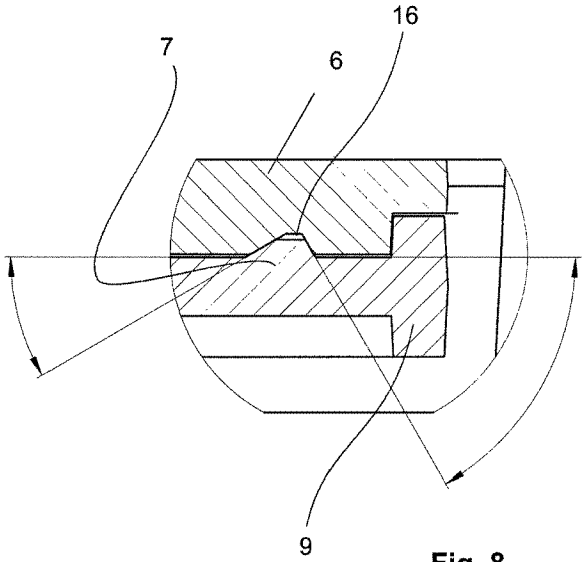
FIG. 8: Detailed section of the detent mechanism in the region of the profile rib

FIG. 8 shows a detailed depiction of the detent mechanism with the notch 7 and the projection 16 of the connector 9. Thus, the connector 9 preferably has a profiled, vertical projection 16 along its longitudinal extension, which interacts with detent mechanism 7 of the upper profile ribs 6*a*, 6*b*. The detent mechanism produces a securing of two packages 1*a*, 1*b* in the longitudinal direction so that they cannot be readily separated again. Once a certain tensile force on the packages 1*a*, 1*b* is overcome, the detent mechanism detaches again so that the plug connection 5, 6, 9 can be detached.

Figure 9:
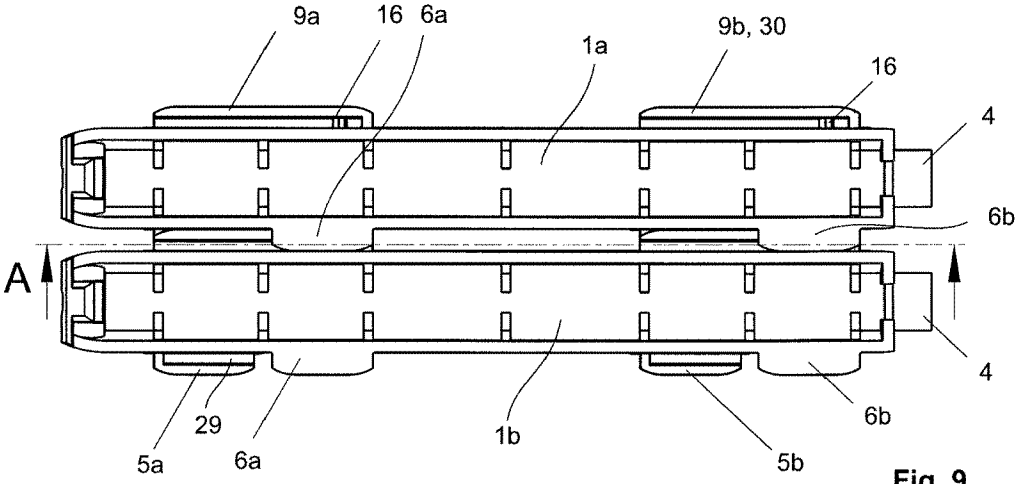
FIG. 9: Top view of two connected packages

FIG. 9 shows a top view of two packages 1*a*, 1*b*. The connectors 9*a*, 9*b* each have a projection 16 along their longitudinal extension, which projection interacts with the detent mechanism 7 of the upper profile ribs 6*a*, 6*b*.

Figure 10:
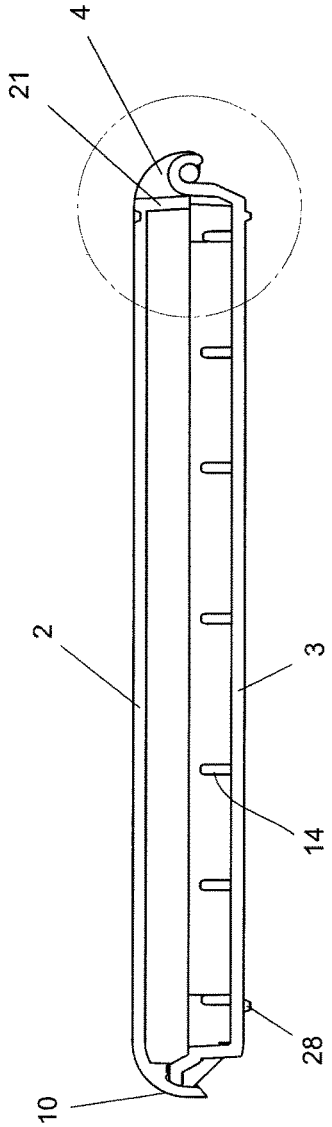
FIG. 10: Sectional view of a closed package

FIG. 10 shows a section through a closed package 1. In a closed state, the cover 2 is situated on the base 3. The cover 2 has a rib 21 in the region of the hinge 4, which makes the closing process of the cover 4 with respect to the base 3 better and more secure.

The arrangement of the rib 21 prevents the cover 2 from twisting with respect to the base region 3 during the closing process. Furthermore, because of the rib 21, the cover 2 can no longer be separated from the base 3 in a closed state. This is necessary particularly when an additional label, which is supposed to protect the packed object from a manipulation, is required in the front grip region 10.

Figure 11:
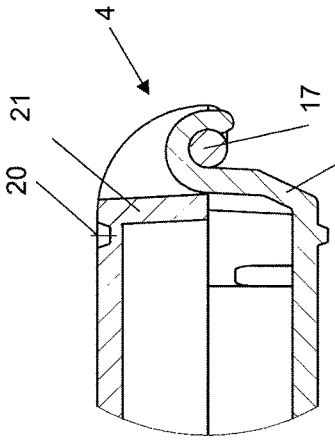
FIG. 11: Detailed representation of the hinge of the package

According to FIG. 11, the hinge 4 that is essential to the invention is depicted again in a closed state, wherein the rib 21 rests on a guide 18 of the base region 3.

The guide 18 is configured such that it serves as a bearing for the pin 17 of the cover 2. In a preferred embodiment, the pin 17 and guide 18 are configured as an articulated connection, wherein the rib 21 prevents a manipulation or a subsequent removal in the closed cover region.

Figure 12:
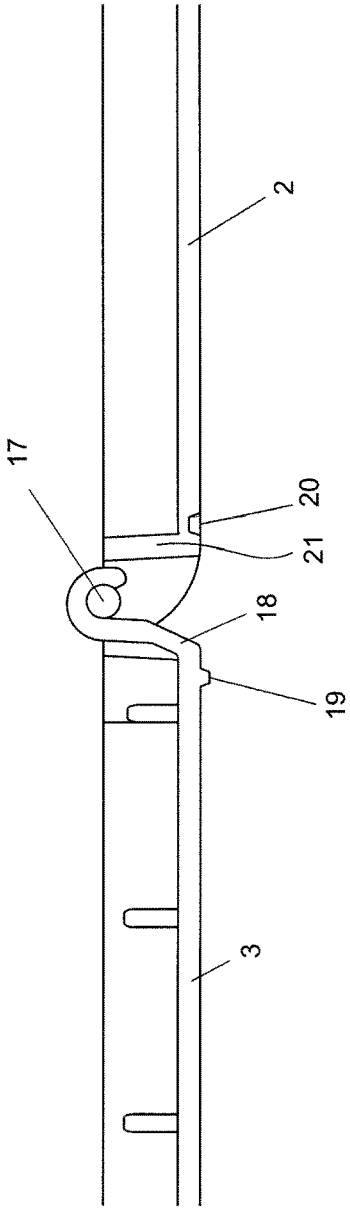
FIG. 12: Depiction of the package in an open state

FIG. 12 shows the package 1 according to the invention in an opened state, wherein the guide 18 grips around the pin by approx. 180 degrees.

Furthermore, FIG. 12 shows a recess 20 in the region of the cover 2 of the package 1*a*, which interacts with a nose 19 of the base 3 of another package 1*b*. When the two packages 1*a*, 1*b* are in a stacked state, the nose 19 engages in a form-fitting manner in the recess 20 of the cover 2 underneath. As a result, a clean stacking of a plurality of individual packages 1*a*, 1*b* is achieved in particular.

Furthermore, a lateral guide 28 is arranged on the base 3 in the front region near the grip. The lateral guide 28 can consist for example of two spaced-apart noses, which are configured such that they grip around the cover 2 underneath so that a displacement of the individual package 1*a*, 1*b* is no longer possible.

A secure stacking on top of one another of the individual packages 1*a*, 1*b* takes place because of the interaction of the noses 28, which prevent a lateral displacement of the individual package 1*a*, 1*b*, and because of the form-fit in the region of the hinge with the nose 19 and the recess 20.

FIGS. 13, 14, 15 and 16 show additional embodiments of the packages 1*a*, 1*b*.

Figure 13:
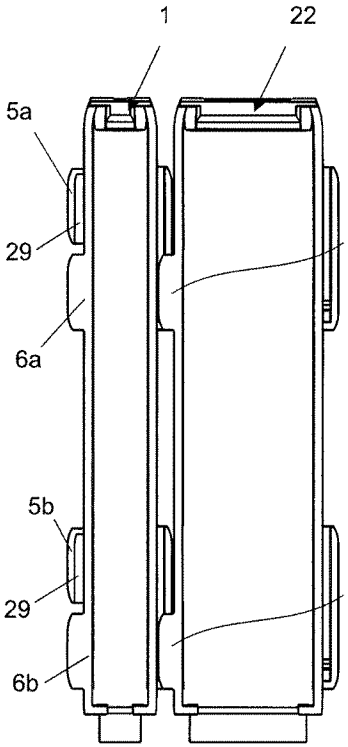

In particular the plug connection that is essential to the invention now makes it possible to connect individual different packages 1 with each other. Thus, FIG. 13 depicts for example a connection of two different packages 1, 22, which vary considerably in terms of size and width.

All packages have the plug connection that is essential to the invention, specifically the profile ribs 5, 6 and the connectors 9.

Figure 14:
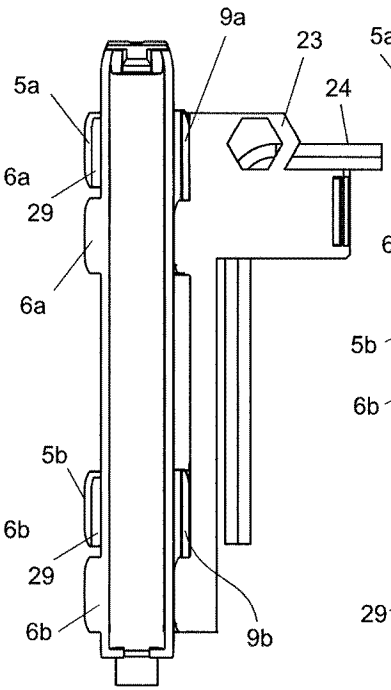

FIG. 14 shows for example the connection of a package 1 to a tool holder 23, which has accommodated an Allen wrench 24. Therefore, it is possible for the first time with the embodiment that is essential to the invention to offer the package 1 for a screw or a drill bit for example with the appropriate tool 23, 24, wherein the two parts 1, 23 are connected to one another in a detachable manner.

Figure 16:
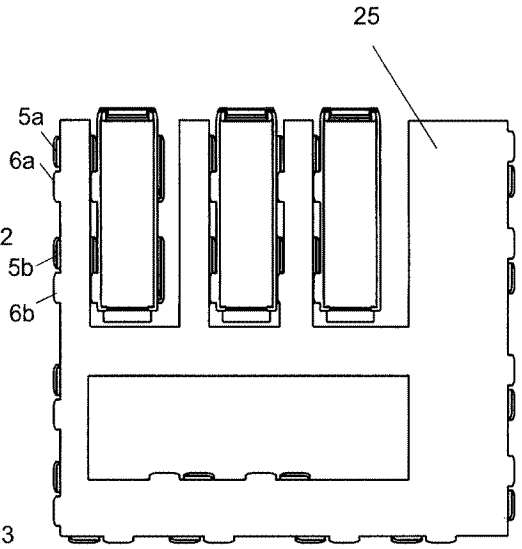
FIGS. 13, 14, 15 and 16: Depictions of different connection possibilities
Figure 15:
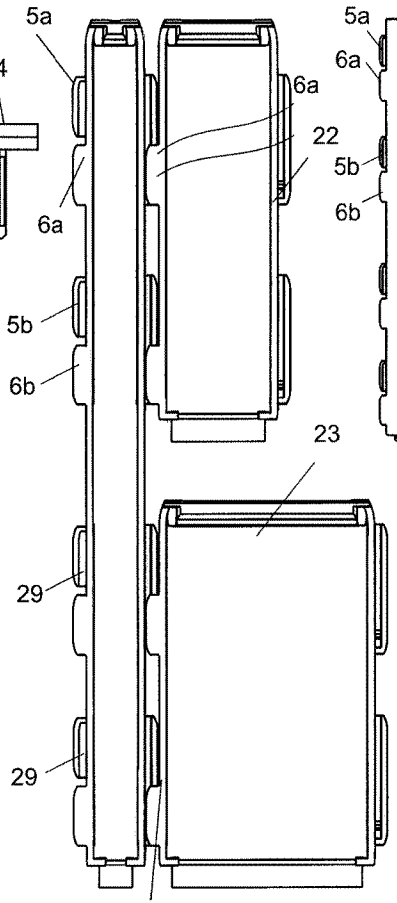

FIG. 16 depicts a package 1, which is connected to a holding plate 25 in a detachable manner. The holding plate 25 can therefore have either the connector 9 or the longitudinal and vertical guides 5 and 6.

DRAWING KEY

1. Package
2. Cover
3. Base
4. Hinge
5. Lower profile rib
6. Upper profile rib
7. Detent mechanism (longitudinal)
8. Longitudinal stop of 5
9. Connector
10. Grip

11. Recess
12. Tongue for 11
13. Centering device
14. Receptacle
15. Offset
16. Projection of 9
17. Pin of 2
18. Guide
19. Nose
20. Recess for 19
21. Rib
22. Package
23. Tool holder
24. Allen wrench
25. Holding plate
26. Insertion chamfer of 6
27. Insertion chamfer of 9
28. Lateral guide
29. Guide groove
30. Profile of 9
31. Free space

The invention claimed is:

1. A package comprising:

a base surrounded by lateral surfaces, and a plug connection for connecting the package to an adjacent package, the plug connection comprising:

at least two lower profile ribs that are arranged on a first lateral surface of the package;

at least two upper profile ribs arranged on the first lateral surface of the package, each of the upper profile ribs being vertically spaced apart from a respective one of the lower profile ribs, each of the upper profile ribs also being offset in a longitudinal direction from the respective one of the lower profile ribs, each of the upper profile ribs cooperating with the respective one of the lower profile ribs to define a guide groove; and at least two connectors that are arranged on a second lateral surface of the package, each of the connectors cooperating with a respective guide groove on the adjacent package to form a detachable plug connection, wherein each of the connectors define a connector profile configured to engage the guide groove in a form-fitting manner when the connector from one package slides within the guide-groove of another package in the longitudinal direction, and wherein each of the guide grooves are arranged on the first lateral surface to define a guide-free free space therebetween in the longitudinal direction.

2. The package of claim 1, wherein each of the lower profile ribs and each of the upper profile ribs define an L-shaped profile, and wherein the connector defines a T-shaped profile.

3. The package of claim 1, wherein at least one of the lower profile ribs has at least one longitudinal stop that cooperates with one of the connectors to limit movement of the connector within the guide groove.

4. The package of claim 1, wherein the upper profile rib defines a notch in the form of a profiled recess and wherein the connector defines a projection that is engageable in-the notch to limit movement of the connector within the guide groove.

5. The package of claim 1, further comprising:

a holding plate that is detachably connectable to the package, wherein the holding plate includes:

at least two sets of a lower plate profile rib and an upper plate profile rib configured to engage the connectors of the package; or at least two sets of plate connectors configured to engage the guide grooves of the package; or both of the at least two sets of the lower plate profile ribs and the upper plate profile ribs configured to engage the connectors of the package, and the at least two sets of the plate connectors configured to engage the guide grooves of the package.

6. The package of claim 1, wherein the package further comprises a cover.

7. The package of claim 6, wherein the cover includes a grip that defines a recess, and wherein the base includes a profiled tongue and a centering device that cooperate with the grip to connect the cover to the base in a locking manner.

8. The package of claim 6, wherein a hinge connects the cover to the base in a slewable manner.

9. The package of claim 8, wherein the hinge includes a guide on the base and a pin on the cover, the cover further including a rib that cooperates with the guide at times when the cover is in a closed position.

10. The package of claim 1, wherein each of the upper profile ribs and the respective one of the lower profile ribs are separated laterally so that there is no overlap.

11. The package of claim 1, wherein the connectors have a length equal to a length of the guide groove.

12. The package of claim 1, wherein a length of the guide-free free space is equal to or greater than a length of the connectors.

13. A holding plate for connection with the package of claim 1, the holding plate comprising:

at least two sets of a lower plate profile rib and an upper plate profile rib configured to engage the connectors of the package; or at least two sets of plate connectors configured to engage the guide grooves of the package; or both of the at least two sets of the lower plate profile ribs and the upper plate profile ribs configured to engage the connectors of the package, and the at least two sets of the plate connectors configured to engage the guide grooves of the package.

14. A package comprising a cover and a base surrounded by lateral surfaces, and a plug connection for connecting the package to an adjacent package, the plug connection comprising:

at least two lower profile ribs that are arranged on a first lateral surface of the package;

at least two upper profile ribs arranged on the first lateral surface of the package, each of the upper profile ribs being vertically spaced apart from a respective one of the lower profile ribs, each of the upper profile ribs also being offset in a longitudinal direction from the respective one of the lower profile ribs, each of the upper profile ribs cooperating with the respective one of the lower profile ribs to define a guide groove; and at least two connectors that are arranged on a second lateral surface of the package, each of the connectors cooperating with a respective guide groove on the adjacent package to form a detachable plug connection, wherein each of the connectors define a connector profile configured to engage the guide groove in a form-fitting manner when the connector from one package slides within the guide groove of another package in the longitudinal direction, and wherein each of the lower profile ribs and each of the respective upper profile ribs are arranged in pairs and define a guide-free free space between them in the longitudinal direction.

15. The package of claim 14, wherein a length of the guide-free free space is equal to or greater than a length of the connectors.

16. The package of claim 14, wherein the cover includes a grip that defines a recess, and wherein the base includes a profiled tongue and a centering device that cooperate with the grip to connect the cover to the base in a locking manner.

17. The package of claim 14, wherein a hinge connects the cover to the base in a slewable manner.

18. The package of claim 17, wherein the hinge includes a guide on the base and a pin on the cover, the cover further including a rib that cooperates with the guide at times when the cover is in a closed position.

* * * * *